US007153791B2

(12) United States Patent
Boylan et al.

(10) Patent No.: US 7,153,791 B2
(45) **Date of Patent: *Dec. 26, 2006**

(54) VINYL ACETATE/ETHYLENE AND ETHYLENE/VINYL CHLORIDE BLENDS AS BINDERS FOR NONWOVEN PRODUCTS

(75) Inventors: John Richard Boylan, Bethlehem, PA (US); Conrad William Perry, Trexlertown, PA (US)

(73) Assignee: Air Products Polymers, L.P., Allentown, PA (US)

( * ) Notice: Subject to any disclaimer, the term of this patent is extended or adjusted under 35 U.S.C. 154(b) by 135 days.

This patent is subject to a terminal disclaimer.

(21) Appl. No.: 10/935,138

(22) Filed: Sep. 7, 2004

(65) Prior Publication Data

US 2006/0052017 A1 Mar. 9, 2006

(51) Int. Cl.

| | |
|---|---|
| ***B32B 9/04*** | (2006.01) |
| ***B32B 5/18*** | (2006.01) |
| ***C08F 20/10*** | (2006.01) |
| ***C08F 16/00*** | (2006.01) |

(52) U.S. Cl. ..... 442/155; 442/327; 442/374; 525/330.3; 525/328.2

(58) Field of Classification Search ..... 442/59, 442/155, 327, 374

See application file for complete search history.

(56) References Cited

U.S. PATENT DOCUMENTS

| | | | | |
|---|---|---|---|---|
| 3,380,842 | A | 4/1968 | Lindemann et al. | |
| 3,380,851 | A | 4/1968 | Lindemann et al. | |
| 3,752,733 | A | 8/1973 | Graham et al. | |
| 3,758,429 | A | 9/1973 | Fallwell, Jr. | |
| 3,787,232 | A | 1/1974 | Mikofalvy et al. | |
| 3,843,580 | A | 10/1974 | Andersen | |
| 4,123,405 | A | 10/1978 | Oyamada et al. | |
| 4,449,978 | A | 5/1984 | Iacoviello | |
| 4,537,831 | A | 8/1985 | DiStefano | |
| 4,590,102 | A | 5/1986 | Rosamilia et al. | |
| 4,745,025 | A | 5/1988 | Mao | |
| 4,774,283 | A | 9/1988 | Goldstein | |
| 5,109,063 | A | 4/1992 | Cheng et al. | |
| 5,244,695 | A | 9/1993 | Davidowich et al. | |
| 5,614,256 | A | 3/1997 | Wierer et al. | |
| 2006/0052018 | A1* | 3/2006 | Boylan et al. | 442/158 |

FOREIGN PATENT DOCUMENTS

| | | |
|---|---|---|
| EP | 1375542 | 1/2004 |

OTHER PUBLICATIONS

Air Products Technical Bulletin 151-470, AIRFLEX® 105 Emulsion for Nonwovens, 1980, 1984.

Air Products Technical Bulletin 151-9317, AIRFLEX® 108 Ultra-Low Formaldehyde Emulsion for Nonwovens, 1992.

Air Products Technical Bulletin 151-9947, AIRFLEX® Ethylene-Vinyl Chloride (EVCL) Emulsions for Nonwovens and Textiles, 1999.

* cited by examiner

*Primary Examiner*—Terrel Morris
*Assistant Examiner*—Lynda M. Salvatore
(74) *Attorney, Agent, or Firm*—Mary E. Bongiorno; Russell L. Brewer

(57) ABSTRACT

This invention is directed to an improvement in binders particularly suited for use in preparing nonwoven products and to the nonwoven products. The improved binders comprise a blend of emulsion polymerized ethylene-vinyl chloride (EVCl) polymer and an emulsion polymerized self crosslinkable vinyl acetate-ethylene-N-methylolacrylamide (VAE-NMA) polymer. The blends of the EVCl polymer emulsion and the VAE-NMA polymer emulsion can be applied to cellulose and cellulose/synthetic nonwoven substrates and cured in the absence of an acid catalyst to provide a self-sustaining web having excellent wet strength performance. The blends of EVCl and VAE-NMA polymers do not require an acid catalyst to facilitate cure.

14 Claims, No Drawings

VINYL ACETATE/ETHYLENE AND ETHYLENE/VINYL CHLORIDE BLENDS AS BINDERS FOR NONWOVEN PRODUCTS

BACKGROUND OF THE INVENTION

Nonwoven products consisting of cellulose or cellulose/synthetic fibers that possess wet strength characteristics typically are produced by impregnating the fibers with an emulsion polymer which is capable of crosslinking. Crosslinking results in an polymer that imparts water resistance to the nonwoven products. Many self crosslinking polymers are formed by copolymerizing a variety of monomers such as vinyl acetate, ethylene, vinyl chloride and alkyl esters of acrylic acid with a functional monomer such as N-methylolacrylamide (NMA) that provides the useful capability of self crosslinking to itself and to cellulosic surfaces to form self-sustaining webs.

The following references are cited as representative of the prior art:

Air Products Technical Bulletin "AIRFLEX® 105 Emulsion for Nonwovens" discloses aqueous based vinyl acetate-ethylene-NMA polymer emulsions and their use in producing nonwoven products. To facilitate cure through the NMA group, a variety of dicarboxylic acids, such as, oxalic acid, citric acid, and inorganic acid salts such as sodium bisulfate and ammonium chloride are employed.

Air Products Technical Bulletin 151-9317, "AIRFELX® 108 Ultra -Low Formaldehyde Emulsions for Nonwovens" discloses vinyl acetate-ethylene emulsions for use in producing nonwoven products. The resins are self crosslinking and provide good wet strength performance. The addition of an acid catalyst is recommended to accelerate and promote cure of the binder during the heating phase.

Air Products Technical Bulletin entitled "AIRFLEX® Ethylene-Vinyl Chloride (EVCL) Emulsions for Nonwovens and Textiles" discloses the use of ethylene-vinyl chloride polymer emulsion as binders for nonwoven applications. Enhancement of the wet tensile properties is achieved by effecting crosslinking with an external crosslinker such as melamine or urea formaldehyde resins.

U.S. Pat. No. 3,380,851 discloses nonwoven fabrics bonded with an interpolymer of vinyl acetate, ethylene and from about 0.5 to 10% of an intrinsic acrylamide based upon vinyl acetate. NMA is the self crosslinking monomer employed. The binder is applied to the fibers in an amount from 20 to 100% on a dry weight basis. Then, addition of a mineral acid catalyst is suggested as a mechanism for promoting curing of the interpolymer.

U.S. Pat. No. 3,787,232 discloses the formation of vinyl and vinylidene halide polymers prepared by the emulsion polymerization of vinylidene halide monomer with a carboxylic acid monomer and an N-alkylol amide monomer for use in coating fibers. The low pH latex polymers are alleged as being curable at low temperature U.S. Pat. No. 4,449,978 discloses a nonwoven product bonded with an emulsion binder comprising vinyl acetate, ethylene, and a 50/50 mole mixture of NMA/acrylamide that provides nonwoven products having low residual free formaldehyde content and good tensile properties. Cure of the binder to achieve crosslinking of the NMA is accomplished by addition of an acid catalyst.

U.S. Pat. No. 4,590,102 discloses the production of nonwoven products by impregnation with an emulsion binder based on vinyl acetate, ethylene, and NMA or an emulsion based on a vinyl chloride, ethylene, and NMA interpolymer. A low temperature curing agent having a pKa ranging from about 1 to 2 is employed to facilitate cure. Examples of low temperature curing agents included organic dicarboxylic acids such as oxalic acid and maleic acid.

U.S. Pat. No. 5,244,695 discloses a coating composition for producing filters comprising from 10 to 90% of a fully hydrolyzed polyvinyl alcohol, and from 0 to 90%, preferably from 30 to 70% of an aqueous polymeric emulsion consisting of an aqueous emulsion of a vinyl acetate-NMA polymer or an ethylene-vinyl chloride polymer. Both aqueous polymer emulsions may be used in combination in an amount from 15:85 to 85:15. The saturated nonwoven finds utility in air, oil, fuel and vacuum filter media. An acid catalyst is preferably added to the formulation to aid in the crosslinking of the resin.

U.S. Pat. No. 3,752,733 and U.S. Pat. No. 3,758,429 disclose ethylene-vinyl chloride interpolymers suited for forming nonwoven products. The '733 patent discloses the incorporation of from 0.1 to 10% acrylamide and the '429 patent discloses the incorporation of NMA to produce a crosslinkable interpolymer. To enhance the laundering and dry cleaning resistance of the nonwoven product the interpolymers are condensed and cured by reacting with an aminoplast.

BRIEF SUMMARY OF THE INVENTION

This invention is directed to an improvement in binders particularly suited for use in preparing nonwoven products and to the nonwoven products. The improved binders are comprised of a blend of an emulsion polymerized ethylene-vinyl chloride (EVCl) polymer and an emulsion polymerized self crosslinkable vinyl acetate-ethylene-N-methylolacrylamide polymer (often referred to as NMA reactive VAE polymer emulsions or VAE-NMA polymer emulsions). The blends of the emulsion polymerized EVCl and the VAE-NMA polymer emulsion can be applied to cellulose and cellulose/synthetic nonwoven substrates, and cured in the absence of an acid catalyst to provide a self-sustaining web having excellent wet strength performance. Traditionally, VAE-NMA polymer emulsions, before application to the nonwoven web of fibers, are mixed with an acid catalyst by the nonwoven producer to facilitate cure and crosslinking. Acid catalyzed emulsions have a limited shelf life. Surprisingly, the blends of EVCl polymer emulsion and VAE-NMA polymer emulsion do not require an acid catalyst to achieve enhanced wet strength.

Significant advantages can be achieved with the use of blends of EVCl and VAE-NMA polymer emulsions and these include:

- an ability to allow a nonwoven user of the blend to achieve excellent water resistance, and possibly achieve the full benefit of NMA crosslinking, without the need to post add an acid catalyst;
- an ability to eliminate the safety concerns associated with handling an acid catalyst;
- an ability to produce nonwoven products having tensile strengths that are equivalent to nonwoven products bonded to together with VAE-NMA polymer emulsion containing acid catalysts; and
- an ability to produce EVCl/VAE-NMA polymer emulsion blends having good shelf life stability, and therefore, produce a "boater ready" emulsion.

DETAILED DESCRIPTION OF THE INVENTION

Aqueous based VAE-NMA polymer emulsions are well known and can be formed by conventional emulsion polymerization techniques. The VAE-NMA polymer emulsion generally is comprised of 50 to 94 wt %, preferably 64 to 79 wt %, vinyl acetate, 5 to 40 wt %, preferably from 20 to 30 wt %, ethylene, and 0.5 to 10 wt %, preferably 1 to 6%, NMA, based on the total weight of the polymer. These emulsions can be prepared according to the teachings in U.S. Pat. No. 3,380,851 which is hereby incorporated herein by reference. Low formaldehyde, self crosslinking vinyl acetate-ethylene-NMA polymers can be formulated in accordance with the teachings of U.S. Pat. No. 4,449,978, which is hereby incorporated herein by reference. In the '978 disclosure a 50/50 mixture of NMA and acrylamide is used as the mechanism for producing low formaldehyde crosslinkable polymers for nonwoven products.

Aqueous ethylene-vinyl chloride (EVCl) polymer emulsions for use in preparing nonwoven and textile products are well known and sold commercially. These polymer emulsions are formed by emulsion polymerizing vinyl chloride and ethylene with acrylamide or a derivative such as N-methylolacrylamide. The EVCl polymers typically have a Tg from 0 to 50° C., and comprise about 55 to 95 wt %, preferably 60 to 90 wt %, vinyl chloride, about 5 to 35 wt %, preferably 10 to 30 wt %, ethylene, and from 0.1 to 10 wt %, preferably from 1.5 to 5 wt %, acrylamide and/or N-methylolacrylamide, based on the total weight of polymer. Other monomers can be emulsion polymerized into the polymer generally in small amounts. They include but are not limited to a $C_1$ to $C_{15}$ alkyl vinyl ester; a $C_1$ to $C_{15}$ alkyl acrylate or a $C_1$ to $C_{15}$ alkyl methacrylate, such as methyl (meth)acrylate, ethyl (meth)acrylate, propyl (meth)acrylate, butyl (meth)acrylate, and 2-ethylhexyl (meth)acrylate; a $C_1$ to $C_6$ hydroxyalkyl (meth)acrylate, such as, hydroxyethyl (meth)acrylate and hydroxypropyl (meth)acrylate; a $C_1$ to $C_{15}$ alkyl maleate; a $C_1$ to $C_{15}$ alkyl fumarate; acrylic acid; methacrylic acid; mono and diesters of alpha, beta-unsaturated $C_4$–$C_{10}$ alkenedioic acids such as maleic acid, fumaric acid, and itaconic acid; $C_1$–$C_{18}$ alkanols; N-methylol amides, $C_1$–$C_4$ alkanoic acid ethers of N-methylol amides; allylcarbamates, such as acrylonitrile, methacrylamide, N-methylol methacrylamide, N-methylol allylcarbamate; $C_1$–$C_4$ alkyl ethers or $C_1$–$C_4$ alkanoic acid esters of N-methylol acrylamide, sodium vinyl sulfonate; and 2-acrylamido-2-methyl propanesulfonate. The monomers can be incorporated in minor amounts, e.g. from 0 to about 10% by weight. In another embodiment, the EVCl polymers comprise 70 to 85 wt % vinyl chloride, 13 to 26 wt % ethylene, and 2 to 4 wt % acrylamide and/or N-methylolacrylamide, based on the total weight of polymer.

In the polymerization method, an aqueous emulsion reaction mixture containing substantially all of the stabilizing system and a portion, preferably at least 5%, of the total vinyl chloride monomer is charged to the reaction vessel. The vessel is pressurized with ethylene in an amount to provide the polymer with a 5 to 35 wt % ethylene content and then the reaction mixture initiated by the addition of a free radical generating source. Polymerization is continued with addition of vinyl chloride and comonomer until the rate of polymerization essentially terminates. The polymerization typically is terminated at that point and the unreacted components removed from the emulsion. Descriptive processes for producing EVCl polymer emulsions are provided in U.S. Pat. No. 3,752,733 and U.S. Pat. No. 3,758,429 which are hereby incorporated herein by reference.

The blends suited for producing binder systems for nonwoven products can easily be accomplished with the use of most types of equipment and mixing vessels known in the art of aqueous liquid blend preparation. The blends contain, per 100 weight parts of total polymer (dry basis), about 5 to 70 weight parts of the EVCl polymer, less than 10 weight parts of a third polymer, and the balance the VAE-NMA polymer. Preferably, the blend consists of from 50 to 80 weight parts of the VAE-NMA polymer emulsion and from 20 to 50 weight parts of the EVCl polymer emulsion. Other polymers may be incorporated into the blend in an amount less than 10% by weight, i.e., 0 to 10% by weight; preferably such polymers are not reactive with NMA. Examples of other polymers include poly(vinyl acetate) and acrylic polymers based on lower alkyl esters of (meth)acrylic acid. Preferably, the blends consist essentially of an EVCl emulsion and a VAE-NMA emulsion and they exclude NMA reactive polymers such as poly(vinyl alcohol) and carboxyl containing polymers.

In general, a preselected amount of the VAE-NMA polymer emulsion is added to a blending vessel and agitated. Then, a preselected amount of EVCl polymer emulsion is added to the blend vessel and mixed for a suitable amount of time to allow for a homogeneous mixture. This blend then can then be impregnated in a nonwoven web of fibers, e.g., and the water removed by drying. Typically, the blend is incorporated in an amount of at least 3% by weight of the substrate, up to about 50%, and generally from 10 to 30% by weight of the substrate (dry basis). Cure is effected during the drying step which includes heating to a temperature of typically from 65 to 180° C., in order to remove water from the nonwoven product.

Representative emulsions employed for producing blends have the follow physical properties:

| | Range of Properties | Measured Properties 90% VAE-NMA 10% EVCl | Measured Properties 75% VAE-NMA 25% EVCl |
|---|---|---|---|
| Solids | 40–60% | 48% | 48% |
| pH | 5–8 | 5.7 | 5.9 |
| Viscosity | 50–800 cps | 86 | 148 |

Representative polymer emulsion blends have the following general percentage of ingredients based on the emulsion solids:

| | VAE-NMA % of Dry Solids | EVCl % of Dry Solids | Other Polymer % of Dry solids |
|---|---|---|---|
| Range | 30 to 95% | 5 to 70% | 0 to 10% |
| Preferred Range | 50 to 80% | 20 to 50% | 0 to 10% |
| Most Preferred Range | 65 to 75% | 25 to 35% | 0 to 10% |

The following examples are provided to illustrate various embodiments of the invention and are not intended to restrict the scope thereof:

GENERAL PROCEDURE

The acid catalyst used in the comparative examples is sodium bisulfate unless otherwise noted. Representative VAE-NMA polymer emulsions are commercially available from Air Products Polymers, L.P., under the trademark AIRFLEX® 105, AIRFLEX108, and AIRFLEX 192. The EVCl polymer emulsions are available from Air Products Polymers, L.P., under the trademark AIRFLEX 4500, AIRFLEX 4514, and AIRFLEX 4530.

The emulsions were spray applied at 20% solids to both sides of a cellulose/synthetic substrate having a basis weight of 60 grams/sq. meter. The emulsion add-on was targeted for 20% dry polymer based on the weight of dry substrate. The sprayed emulsions were cured in a through-air oven at a temperature of 320° F. (160° C.) for three minutes. The dry and wet tensile breaking strength of the resulting nonwoven webs were measured according to ASTM method D 5035-95.

EXAMPLE 1

Comparison of Wet Tensile Strength of Webs Bound with VAE-NMA/EVCl Polymer Emulsions in Differing Proportions A series of blends was prepared in order to determine the wet tensile strength of the nonwoven substrates that were spray applied with various blends of the VAE-NMA/EVCl polymer emulsions starting with 100% of the VAE-NMA polymer emulsion to 100% of the EVCl polymer emulsion. The VAE-NMA dry polymer composition consisted of 75% vinyl acetate, 21% ethylene, 2% N-methylolacrylamide, and 2% acrylamide. The EVCl dry polymer composition consisted of 84% vinyl chloride, 14% ethylene and 2% acrylamide. An acid catalyst was not added to any of the emulsions shown in this example. Table 1 sets forth the results.

TABLE 1

Wet Tensile Strength of Webs Bound with VAE-NMA/EVCI Emulsions % Dry Emulsion

| Binder | 100% VAE-NMA | 75% VAE-NMA 25% EVCI | 50% VAE-NMA 50% EVCI | 25% VAE-NMA 75% EVCI | 10% VAE-NMA 90% EVCI | 100% EVCI |
|---|---|---|---|---|---|---|
| Wet Tensile g/5 cm (without catalyst) | 1495 | 1797 | 1675 | 1442 | 1270 | 887 |

The results in Table 1 illustrate that at a level of 25 and 50% EVCl, the blends provide superior wet strength performance compared to an uncatalyzed VAE-NMA polymer emulsion alone. Levels of 75% EVCl and greater in the blend show wet strength performance less than or equivalent to the non-catalyzed VAE-NMA polymer emulsion. Superior wet strengths were achieved with blends of from 25 to 50% EVCl and VAE-NMA as compared to the 100% VAE-NMA emulsion polymer. This feature was surprising in light of the fact that the wet strength of a nonwoven product using a 100% EVCl emulsion polymer was significantly less than the VAE-NMA emulsion polymer alone. One might have expected a decrease in wet strength of nonwoven products as the level of EVCl in the blend was increased.

EXAMPLE 2

Comparison of Wet Tensile Strength of Webs Bound with VAE-NMA/EVCl Polymer Emulsions and Cured with Acid Catalysts A series of nonwoven products was prepared in accordance with Example 1 except some of the VAE polymers were cured with an acid catalyst and some relied on using the EVCl polymers alone as a catalyst or wet strength promoter. The VAE and EVCl polymer compositions employed were those reported in Example 1. Table 2 sets forth the results.

TABLE 2

Wet Tensile Strength of Webs Bound with VAE-NMA/EVCI Polymer Emulsions % Dry Emulsion

| Binder | 100% VAE-NMA | 95% VAE-NMA 5% EVCI | 90% VAE-NMA 10% EVCI | 80% VAE-NMA 20% EVCI | 75% VAE-NMA 25% EVCI |
|---|---|---|---|---|---|
| Wet Tensile g/5 cm (catalyst addition) | 1871 | 1908 | 1677 | 1722 | 1763 |
| Wet Tensile g/5 cm (No catalyst addition) | 1585 | 1711 | 1867 | 1859 | 1884 |

The results from Table 2 show that the wet strength performance of nonwoven webs bound with acid catalyzed VAE-NMA polymers are superior to non catalyzed VAE-NMA polymers. This is as expected and shows the effect of crosslinking of the NMA function in a VAE-NMA polymer. Surprisingly the wet strengths of nonwoven webs bonded with the EVCl/VAE-NMA blends in amounts from 10 to 25% EVCl, without the addition of the acid catalyst, were equivalent to the acid catalyzed control VAE-NMA bonded nonwoven product. The wet strength performance of the non catalyzed blends of VAE-NMA and EVCl polymer emulsions was significantly superior to the non catalyzed VAE-NMA polymer emulsions. Another surprising feature illustrated by the results is that the blends, when catalyzed to facilitate crosslinking of the NMA, did not result in superior wet strength to the non acid catalyzed blend. In contrast, the catalyzed blends did not perform as well as the non catalyzed blends.

EXAMPLE 3

Effect of Vinyl Chloride Monomer in the EVCl Copolymer Backbone

Table 3 demonstrates the nonwoven wet tensile performance of nonwoven substrates bonded with VAE-NMA/EVCl blend polymer emulsions where the EVCl polymer varies according to the amount of vinyl chloride monomer in the EVCl copolymer backbone. Blends were formed based upon 75 parts VAE-NMA and 25 parts EVCl, dry solids basis. The VAE-NMA composition is that detailed in example 1. The EVCl dry polymer compositions are shown in Table 3.

TABLE 3

| Binder | 100% VAE-NMA without catalyst | 100% VAE-NMA with Catalyst | Blend of VAE-NMA with EVCI | Blend of VAE-NMA with EVCI | Blend of VAE-NMA with EVCI |
|---|---|---|---|---|---|
| Content of EVCI | | | 84% vinyl chloride 14% ethylene 2% acrylamide | 75% vinyl chloride 22% ethylene 3% acrylamide | 71% vinyl chloride 26% ethylene 3% acrylamide |
| Wet Tensile g/5 cm | 1417 | 1621 | 1708 | 1673 | 1524 |

The results show that the wet strength of the nonwoven web at 25 parts EVCl decreases with a decrease in vinyl chloride content in the polymer. Yet all blends resulted in superior wet strength performance compared to the noncatalyzed VAE-NMA impregnated nonwoven.

EXAMPLE 4

EVCl Polymer Contains NMA in the Polymer Backbone

This example illustrates the wet strength performance of a nonwoven web bound with a VAE-NMA/EVCl polymer blend where the EVCl copolymer also contains NMA in the polymer backbone. The emulsions were blended at a dry solids ratio of 75% VAE-NMA and 25% EVCl. No acid catalyst was added to the VAE-NMA/EVCl polymer blends. Table 4 show the results which includes the Table 3 results.

TABLE 4

Wet Tensile Performance of Web Bound with Blends of VAE-NMA and EVCI Polymer Emulsions; Varying EVCI Type

| Binder | 100% VAE-NMA without catalyst | 100% VAE-NMA with Catalyst | VAE-NMA Blend with EVCI | VAE-NMA Blend with EVCI | VAE-NMA Blend with EVCI | VAE-NMA Blend with EVCI-NMA polymer |
|---|---|---|---|---|---|---|
| Content of EVCI | | | 84 wt % vinyl chloride 14 wt % ethylene 2 wt % acrylamide | 75 wt % vinyl chloride 22% ethylene 3% acrylamide | 71% vinyl chloride 26% ethylene 3% acrylamide | 83 wt % vinyl chloride 14 wt % ethylene 3 wt % NMA |
| Wet Tensile g/5 cm | 1417 | 1621 | 1708 | 1673 | 1524 | 1775 |

Table 4 illustrates that some increase in wet strength properties of the nonwoven substrate is achieved by the addition of NMA in the EVCl polymer as opposed to acrylamide. However, the difference is slight.

EXAMPLE 5

Effect of Ethylene Concentration in VAE-NMA Polymer Emulsion

Nonwoven webs were prepared in accordance with the procedure of Example 4 except the ethylene content was varied. The results are shown in Table 5.

TABLE 5

Wet Tensile Strength of Web Bound with VAE-NMA Polymer Emulsions And VAE-NMA/EVCI Polymer Emulsion Blends

| Binder | 100% VAE-NMA | 75% VAE-NMA 25% EVCI | 100% VAE-NMA | 75% VAE-NMA 25% EVCI |
|---|---|---|---|---|
| Content of VAE-NMA | 65 wt % vinyl acetate 31 wt % ethylene 2 wt % NMA 2 wt % acrylamide | 65 wt % vinyl acetate 31 wt % ethylene 2 wt % NMA 2 wt % acrylamide | 74 wt % vinyl acetate 21 wt % ethylene 5 wt % NMA | 74 wt % vinyl acetate 21 wt % ethylene 5 wt % NMA |
| Content of | | 84 wt % vinyl chloride | | 84 wt % vinyl chloride |

TABLE 5-continued

Wet Tensile Strength of Web Bound with VAE-NMA Polymer Emulsions And VAE-NMA/EVCI Polymer Emulsion Blends

| Binder | 100% VAE-NMA | 75% VAE-NMA 25% EVCI | 100% VAE-NMA | 75% VAE-NMA 25% EVCI |
|---|---|---|---|---|
| EVCI | | 14 wt % ethylene 2 wt % acrylamide | | 14 wt % ethylene 2 wt % acrylamide |
| Wet | 1483 | 1485 | 1995 | 2004 |

TABLE 5-continued

| Wet Tensile Strength of Web Bound with VAE-NMA Polymer Emulsions And VAE-NMA/EVCI Polymer Emulsion Blends | | | | |
|---|---|---|---|---|
| Binder | 100% VAE-NMA | 75% VAE-NMA 25% EVCI | 100% VAE-NMA | 75% VAE-NMA 25% EVCI |
| Tensile g/5 cm (with catalyst) | | | | |
| Wet Tensile g/5 cm (without catalyst) | 1456 | 1617 | 1717 | 2059 |

Table 5 shows similar results to those of Example 2 in that superior wet strength results were achieved with non catalyzed blends compared to the non catalyzed VAE-NMA polymer emulsions. However, unexpectedly, the wet strength of the catalyzed blend also gave similar to superior results compared to the catalyzed VAE-NMA polymer emulsions.

EXAMPLE 6

Effect of EVCl on the Viscosity of VAE Nonwoven Binders

The purpose of this example was to determine the viscosity effect of EVCl polymer emulsions when blended with VAE polymer emulsions and whether the blends show an adverse viscosity increase rendering them unacceptable due to inadequate shelf life. One desired outcome of the VAE-NMA/EVCl blends is that of a stable shelf life viscosity. Such stability is not always possible when certain acid catalysts are blended with the VAE-NMA polymer emulsions. When certain acid catalysts are used, the over all pH of the polymer emulsion drops to such a level that premature crosslinking of the VAE-NMA polymer can occur resulting in a significant rise in viscosity of the polymer emulsion. The rise in viscosity of the polymer emulsion can render the polymer emulsion unusable due to application limitations.

Table 6 below illustrates the heat age viscosity rise observed after 1% addition of (dry on dry emulsion) sodium bisulfate acid catalyst into a VAE-NMA polymer emulsion as compared to a 25% EVCl/75% VAE-NMA (dry %) polymer emulsion that does not contain the acid catalyst. The dry polymer composition of the VAE and EVCl are those that are detailed in Example 1. The heat aging was performed in a convection oven at 120° F. (49° C.) for a two-week period. Viscosities of the polymer emulsions were measured with a Brookfield LV viscometer using a # 3 spindle at a speed of 60 rpm. Viscosities were measured after the polymer emulsion had been removed from the oven and allowed to cool to room temperature.

TABLE 6

| Heat Aged Viscosity Stability | | | |
|---|---|---|---|
| Binder | VAE-NMA Polymer Emulsion No Catalyst | VAE-NMA with $NaHSO_4$ Catalyst | VAE-NMA/EVCI blend (No Catalyst) |
| Initial (Viscosity in centipoises) | 75 | 82 | 148 |
| 1 Week ((Viscosity in centipoises) | 64 | 600 | 180 |
| 2 Week (Viscosity in centipoises) | 74 | 800 | 160 |

Table 6 shows that the control VAE-NMA acid catalyzed polymer emulsions result in a significant viscosity increase within one week and continue to rise, whereas the viscosity of the VAE-NMA/EVCl blend, without acid catalyst, show essentially no increase in viscosity.

What is claimed is:

1. A nonwoven product comprising a nonwoven web of fibers to which is applied a non acid catalyzed binder to form a binder impregnated web, the non acid catalyzed binder comprised of an emulsion blend of a first polymer comprised of emulsion polymerized units of vinyl acetate, ethylene, and N-methylolacrylamide, and a second polymer comprised of emulsion polymerized units of vinyl chloride, ethylene and N-methylolacrylamide or acrylamide or both N-methylolacrylamide and acrylamide, wherein the binder impregnated web is dried sufficiently to bind the fibers together and form a self-sustaining web.

2. The nonwoven product of claim 1 wherein the first polymer comprises 50 to 94 wt % vinyl acetate, 5 to 40 wt % ethylene, and 0.5 to 10 wt % N-methylolacrylamide, based on the total weight of the polymer, and the second polymer comprises 55 to 95 wt % vinyl chloride, 5 to 35 wt % ethylene, and 0.1 to 10 wt % of N-methylolacrylamide or acrylamide or both N-methylolacrylamide and acrylamide, based on the total weight of polymer.

3. The nonwoven product of claim 2 wherein the second polymer comprises 60 to 90 wt % vinyl chloride, 10 to 30 wt % ethylene, and 0.5 to 5 wt % of N-methylolacrylamide or acrylamide or both N-methylolacrylamide and acrylamide, based on the total weight of polymer.

4. The nonwoven product of claim 2 wherein the second polymer comprises 70 to 85 wt % vinyl chloride, 13 to 26 wt % ethylene, and 2 to 4 wt % of N-methylolacrylamide or acrylamide or both N-methylolacrylamide and acrylamide, based on the total weight of polymer.

5. The nonwoven product of claim 3 wherein the first polymer comprises 64 to 79 wt % vinyl acetate, 20 to 30 wt % ethylene, and 1 to 6 wt % N-methylolacrylamide, based on the total weight of the polymer.

6. The nonwoven product of claim 4 wherein the first polymer comprises 64 to 79 wt % vinyl acetate, 20 to 30 wt % ethylene, and 1 to 6 wt % N-methylolacrylamide, based on the total weight of the polymer.

7. The nonwoven product of claim 2 wherein the blend, based on 100 parts by dry weight of total polymer, comprises 5 to 70 parts of the second polymer, less than 10 parts of a third polymer, and the remaining parts consisting of the first polymer.

8. The nonwoven product of claim 2 wherein the blend is comprised of 50 to 80 weight parts of the first polymer and 20 to 50 weight parts of the second polymer, per 100 weight parts of the blend.

9. The nonwoven product of claim 2 wherein the binder is applied to the nonwoven web in an amount of 3% to 50% by weight add-on, on a dry basis.

10. The nonwoven product of claim 2 wherein the binder is applied at about 10% to 30% by weight add-on, on a dry basis.

11. The nonwoven product of claim 2 wherein the blend consists essentially of the first polymer and the second polymer.

12. The nonwoven product of claim 11 wherein the blend excludes N-methylolacrylamide reactive polymers.

13. The nonwoven product of claim 2 wherein the nonwoven web of fibers comprises cellulose or synthetic polymeric fibers or combinations of both cellulose and synthetic polymeric fibers.

14. The nonwoven product of claim 2 wherein the nonwoven web of fibers comprises natural polymeric fibers.

* * * * *